US007506633B2

(12) United States Patent
Cowan

(10) Patent No.: US 7,506,633 B2
(45) Date of Patent: Mar. 24, 2009

(54) PRESS-FIT OF SENSOR ASSEMBLY IN ELECTRONIC THROTTLE CONTROL APPLICATION

(75) Inventor: Nathan Cowan, Chatham (CA)

(73) Assignee: Continental Automotive Canada, Inc., Chatham, Ontario (CA)

( * ) Notice: Subject to any disclaimer, the term of this patent is extended or adjusted under 35 U.S.C. 154(b) by 84 days.

(21) Appl. No.: 11/798,833

(22) Filed: May 17, 2007

(65) Prior Publication Data

US 2007/0295304 A1 Dec. 27, 2007

Related U.S. Application Data

(60) Provisional application No. 60/805,393, filed on Jun. 21, 2006.

(51) Int. Cl.
*F02D 11/10* (2006.01)
*F02D 11/00* (2006.01)

(52) U.S. Cl. ..... 123/399

(58) Field of Classification Search ..... 123/337, 123/399, 494, 612; 73/114.36

See application file for complete search history.

(56) References Cited

U.S. PATENT DOCUMENTS

| | | | | |
|---|---|---|---|---|
| 5,055,781 | A * | 10/1991 | Sakakibara et al. | 324/207.21 |
| 5,070,728 | A * | 12/1991 | Kubota et al. | 73/114.36 |
| 6,725,833 | B1 * | 4/2004 | Irihune et al. | 123/399 |
| 7,007,666 | B2 * | 3/2006 | Kamimura et al. | 123/399 |
| 2003/0178004 | A1 * | 9/2003 | Keefover et al. | 123/399 |
| 2004/0177832 | A1 * | 9/2004 | Irihune et al. | 123/399 |
| 2004/0194757 | A1 * | 10/2004 | Irihune et al. | 123/399 |
| 2005/0092293 | A1 * | 5/2005 | Arai et al. | 123/399 |
| 2005/0103308 | A1 * | 5/2005 | Keefover et al. | 123/337 |
| 2005/0183695 | A1 * | 8/2005 | Keefover et al. | 123/399 |
| 2006/0266329 | A1 * | 11/2006 | Irihune et al. | 123/399 |

* cited by examiner

*Primary Examiner*—Mahmoud Gimie

(57) ABSTRACT

An electronic throttle control housing structure (10) for a vehicle includes an upper housing (12), a lower housing (14) mating with the upper housing, and a sensor assembly (20) clamped between the upper housing and the lower housing. One of the upper housing or the lower housing has surfaces defining slot structure (22, 24) therein. A portion of the sensor assembly is received in the slot structure in interference fit relation with the surfaces defining the slot structure. Thus, no screws or glue is needed to mount the sensor assembly in the housing structure.

20 Claims, 5 Drawing Sheets

PRESS-FIT OF SENSOR ASSEMBLY IN ELECTRONIC THROTTLE CONTROL APPLICATION

This application claims the benefit of the earlier filing date of U.S. Provisional Application No. 60/805,393 filed on Jun. 21, 2006, which is incorporated by reference herein in its entirety.

FIELD OF THE INVENTION

The present invention relates to electronic throttle control and, more particularly, to mounting of a sensor assembly in an electronic throttle control housing.

BACKGROUND OF THE INVENTION

In conventional electronic throttle control for vehicles, the sensor elements are typically secured in a housing by screws or glue. This adds cost to the assembly and often requires larger packaging.

There is a need to provide improved mounting of a sensor assembly in an electronics throttle control housing.

SUMMARY OF THE INVENTION

An object of the invention is to fulfill the need referred to above. In accordance with the principles of the present invention, an electronic throttle control housing structure for a vehicle includes an upper housing, a lower housing mating with the upper housing, and a sensor assembly clamped between the upper housing and the lower housing. One of the upper housing or the lower housing has surfaces defining slot structure therein. A portion of the sensor assembly is received in the slot structure in interference fit relation with the surfaces defining the slot structure.

In accordance with yet another aspect of the invention, a method of retaining a sensor assembly in an electronic throttle control housing structure for a vehicle provides a first housing and a second housing constructed and arranged to mate with the second housing. The second housing has surfaces defining at least one slot structure therein. The first housing has a clamping surface. A sensor assembly is provided and a portion of the sensor assembly is inserted into the slot structure so that the portion is in interference fit relation with the surfaces defining the slot structure. The first housing is coupled to the second housing with the clamping surface engaging a surface of the sensor assembly.

Other objects, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

BRIEF DESCRIPTION OF THE DRAWINGS

The invention will be better understood from the following detailed description of the preferred embodiments thereof, taken in conjunction with the accompanying drawings, wherein like reference numerals refer to like parts, in which.

DETAILED DESCRIPTION OF THE EXEMPLARY EMBODIMENT

Figure 1:
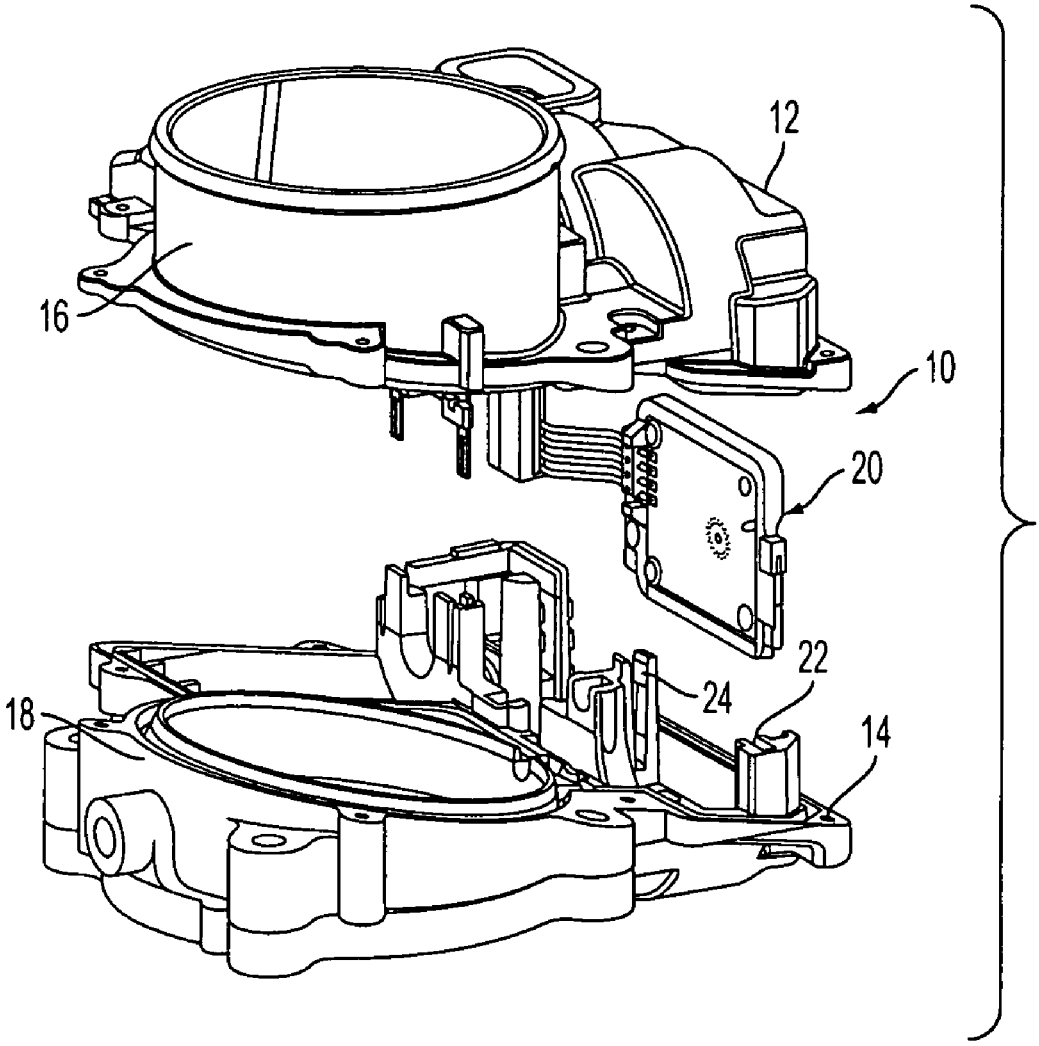
FIG. 1 is an exploded view of a electronic throttle control housing structure for housing a sensor assembly in accordance with an embodiment of the invention.

With reference to FIG. 1, an exploded view of an electronic throttle control housing structure, generally indicated at 10, is shown in accordance with an embodiment of the invention. The housing structure 10 is employed in a vehicle (not shown) having electronic throttle control. The housing structure 10 includes an upper housing 12 and a lower housing 14. The upper housing 12 has a portion 16 that is constructed and arranged to mate with a portion 18 of the lower housing 14 to define a throttle valve housing portion. A conventional throttle valve (not shown) is housed in this housing portion.

A sensor assembly, generally indicated at 20, is retained in the housing structure 10 by means of only an interference fit. The sensor assembly 20 includes a sensor 15 that senses the angle of the throttle plate of the throttle valve and outputs an analog signal that is proportional to this angle. A powertrain control module (not shown) of the vehicle uses this information in closed-loop control with a DC motor in the throttle body to drive the throttle plate to a desired angle. The sensor 15 is associated with a circuit board 19 and a plastic frame 17 generally surrounds the circuit board 19.

Figure 2:
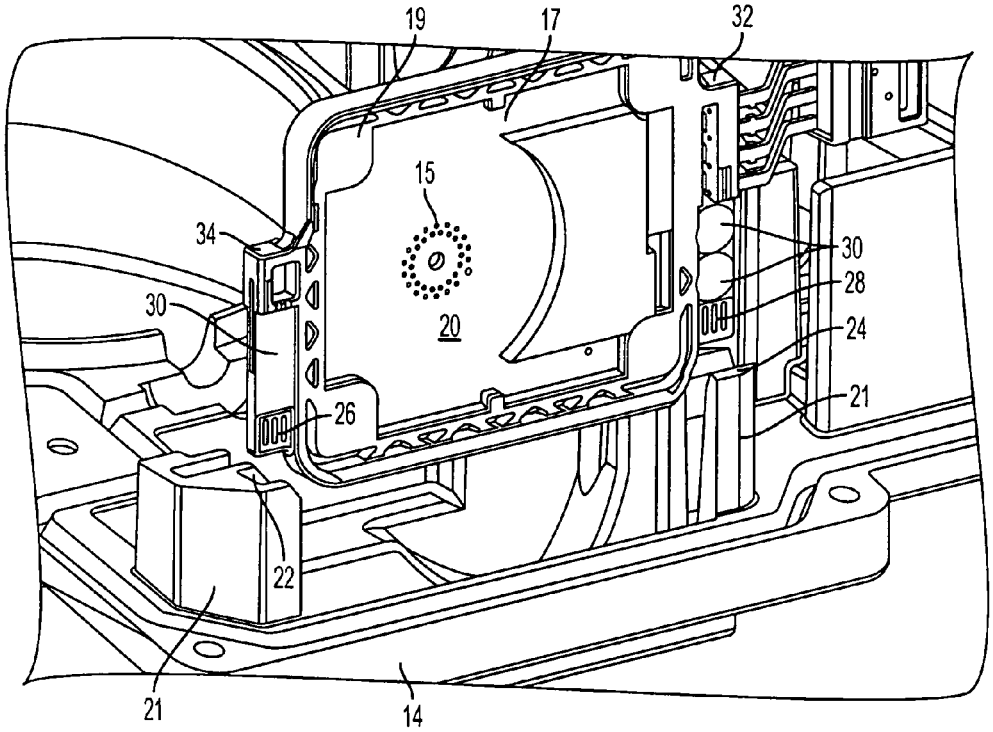
FIG. 2 is an enlarged front view showing the sensor assembly being inserted into a lower housing of the housing structure of FIG. 1.
Figure 3:
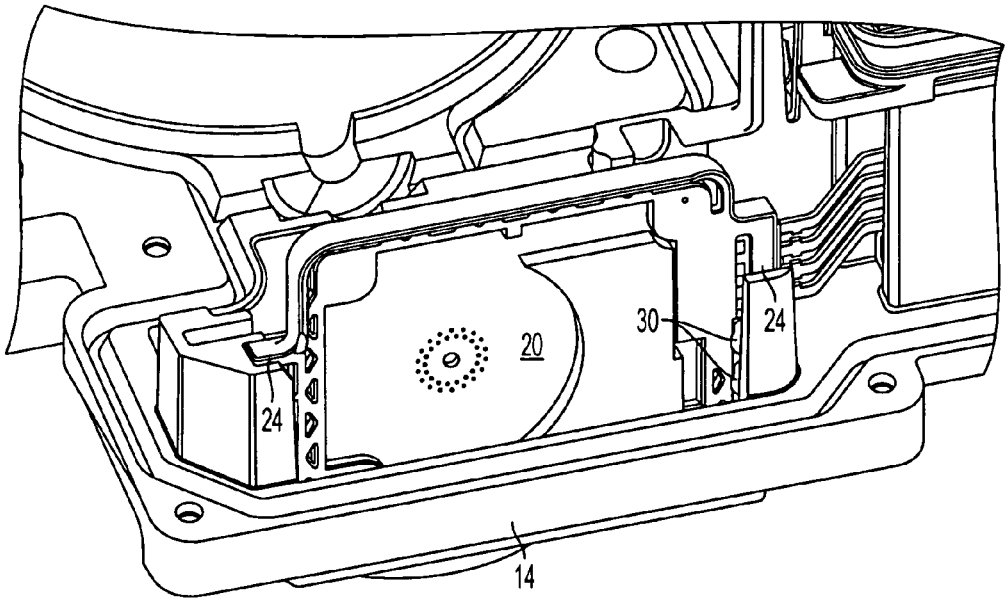
FIG. 3 is an enlarged view showing the sensor assembly fully inserted into the lower housing of FIG. 2.

With reference to FIGS. 1 and 2, the lower housing 14 includes upstanding bosses 21 having surfaces defining slot structure 22 and 24 constructed and arranged to receive in press-fit relation, a respective opposing end 26, 28 of the sensor assembly 20. Thus, the slot structure 22 and 24 define a pair of slots in spaced relation. Each end 26, 28 of the sensor assembly 20 has a deformable portion 30, constructed and arranged to deform upon engagement with the surfaces defining the slot structure 22, 24 so as to ensure retention of the sensor assembly 20 in the lower housing 14. FIG. 3 shows the sensor assembly fully inserted into the slot structure 22, 24 with the deformable portions 30 deformed.

Figure 4:
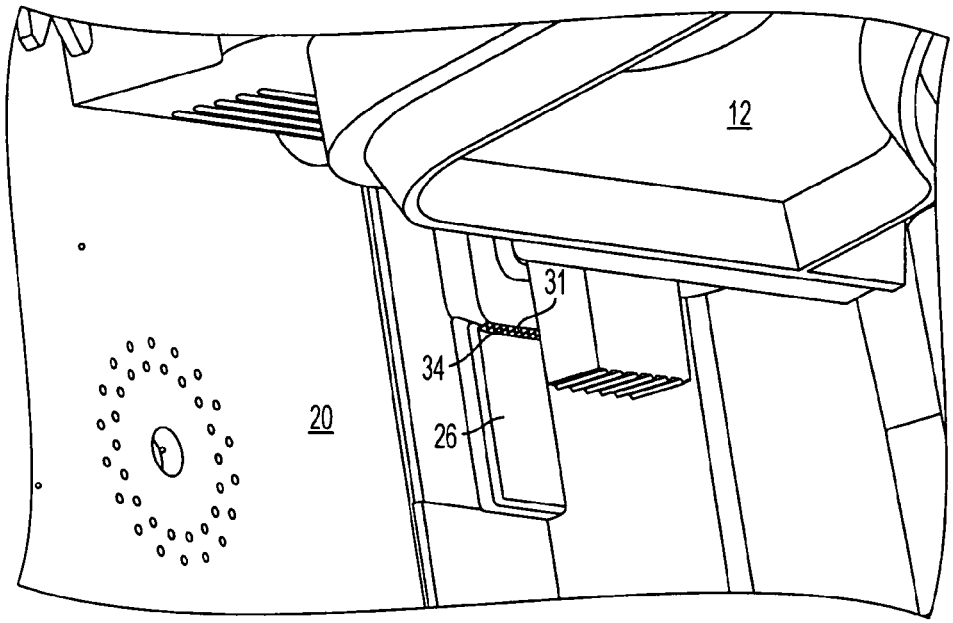
FIG. 4 is a view of the sensor assembly being clamped by an upper housing of the housing structure of FIG. 1.
Figure 5:
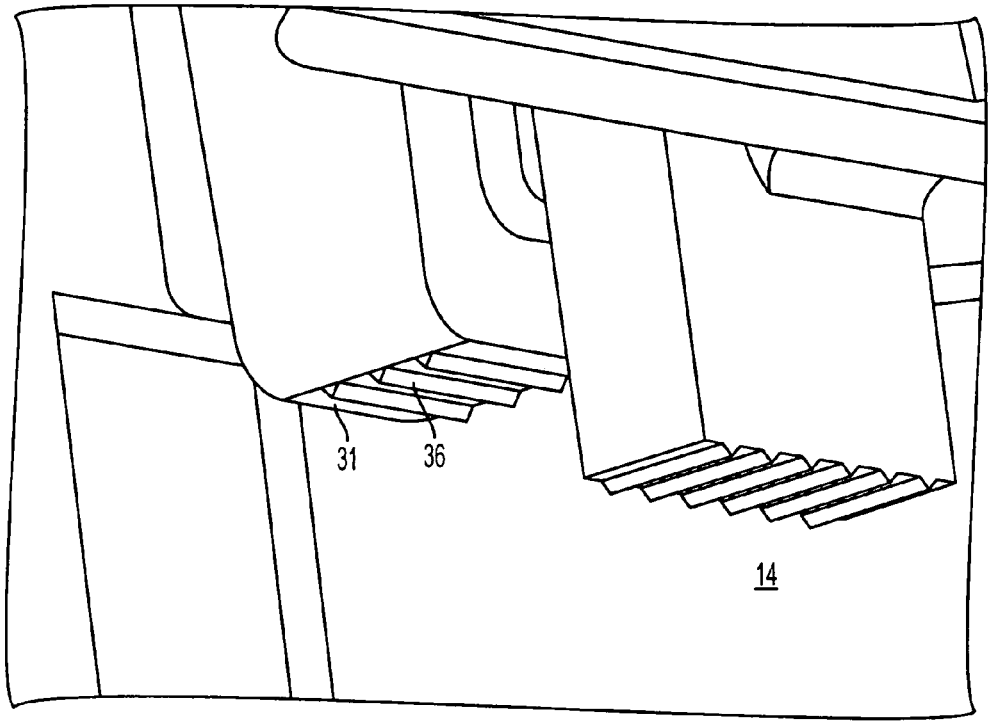
FIG. 5 shows a clamping surface of the upper housing of FIG. 4.

With reference to FIG. 4, once the sensor assembly 20 is inserted fully into the slot structure 22, 24, the upper housing 12 is coupled with the lower housing 14 so as to be in clamping engagement with surfaces of the sensor assembly 20. More particularly, with reference to FIGS. 2 and 4, a clamping surface 31 of the upper housing 12 engages surface 34 of the end 26 of the sensor assembly clamping the sensor assembly between the upper and lower housings. Another surface (not shown) similar to clamping surface 31 engages surface 32 of the sensor assembly 20. As shown in FIG. 5, the clamping surfaces (such as surface 31) that engage the sensor assembly 20 can have surface features such as teeth structure 36 to facilitate clamping. The upper housing 12 and the lower housing 14 clamp on the frame 17 of the sensor assembly 20.

Although in the embodiment, the lower housing 14 includes the slots 22, 24 and the upper housing 12 includes the clamping surfaces 31, it can be appreciated that the slots 22, 24 can be provided in the upper housing 12 with the clamping surfaces 31 provided in the lower housing 14. In addition, although a pair of slots structures are shown, one or more than two slots structures can be provided with corresponding portions of the sensor assembly 20 received therein.

Thus, due to the interference fit and clamping of the sensor assembly 20 in the housing structure 10 there is no need for fasteners or glue to mount the sensor assembly 20 in the housing structure 10. Hence cost is reduced and the overall packaging size can be reduced.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. An electronic throttle control housing structure for a vehicle, the housing structure comprising:

an upper housing, a lower housing mating with the upper housing, and a sensor assembly clamped between the upper housing and the lower housing, wherein one of the upper housing or the lower housing having surfaces defining slot structure therein, a portion of the sensor assembly being received in the slot structure in interference fit relation with the surfaces defining the slot structure, and wherein the sensor assembly has a deformable portion such that when the portion of the sensor assembly is in the interference fit relation, the deformable portion is deformed ensuring retention of the sensor assembly in the slot structure.

2. The housing structure of claim 1, wherein the lower housing includes the slot structure.

3. The housing structure of claim 1, wherein the lower housing includes a pair of slot structures disposed in spaced relation, the sensor assembly having opposing ends, each end being received in an associated slot structure in interference fit relation with the surfaces defining the slot structure.

4. The housing structure of claim 3, wherein each end has a said deformable portion such that when the ends are in the interference fit relation, the deformable portions are deformed ensuring retention of the sensor assembly.

5. The housing structure of claim 2, wherein the upper housing includes a clamping surface engaging a surface of the sensor assembly.

6. The housing structure of claim 3, wherein the upper housing includes a clamping surface engaging a surface of the sensor assembly.

7. The housing structure of claim 6, wherein the clamping surface includes teeth structure.

8. The housing structure of claim 1, wherein the sensor assembly includes a sensor constructed and arranged to sense an angle of the throttle plate of the throttle valve.

9. The housing structure of claim 1, wherein the sensor assembly includes a circuit board and a frame generally surrounding the circuit board and wherein the upper and lower housings clamp on the frame.

10. An electronic throttle control housing structure for a vehicle, the housing structure comprising:

an upper housing, a lower housing mating with the upper housing, and sensor assembly clamped between the upper housing and the lower housing, wherein the lower housing has surfaces defining slot structure therein, a portion of the sensor assembly being received in the slot structure in interference fit relation with the surfaces defining the slot structure, and the upper housing include a clamping surface engaging a surface of the sensor assembly, wherein the clamping surface includes teeth structure.

11. An electronic throttle control housing structure for a vehicle, the housing structure comprising:

an upper housing, a lower housing mating with the upper housing, a sensor assembly clamped between the upper housing and the lower housing, and means, associated with one of the upper housing or the lower housing, for receiving a portion of the sensor assembly in interference fit relation, wherein the sensor assembly has a deformable portion such that when the portion of the sensor assembly is in the interference fit relation, the deformable portion is deformed ensuring retention of the sensor assembly with respect to the means for receiving.

12. The housing structure of claim 11, wherein said means for receiving are surfaces defining slot structure in the lower housing.

13. The housing structure of claim 12, wherein the slot structure includes a pair of slots disposed in spaced relation, the sensor assembly having opposing ends, each end being received in an associated slot in interference fit relation with the surfaces defining the slot.

14. The housing structure of claim 13, wherein each end has a said deformable portion such that when the ends are in the interference fit relation, the deformable portions are deformed ensuring retention of the sensor assembly.

15. The housing structure of claim 12, wherein the upper housing includes clamping surfaces engaging surfaces of the sensor assembly.

16. The housing structure of claim 15, wherein the clamping surfaces include teeth structure.

17. The housing structure of claim 11, wherein the sensor assembly includes a sensor constructed and arranged to sense an angle of the throttle plate of the throttle valve.

18. The housing structure of claim 11, wherein the sensor assembly includes a circuit board and a frame generally surrounding the circuit board and wherein the upper and lower housings clamp on the frame.

19. A method of retaining a sensor assembly in an electronic throttle control housing structure for a vehicle, the method comprising:

providing a first housing, and a second housing constructed and arranged to mate with the second housing, the second housing having surfaces defining at least one slot structure therein, the first housing having a clamping surface, providing a sensor assembly having a deformable portion, inserting a portion of the sensor assembly in the slot structure so that the portion is in interference fit relation with the surfaces defining the slot structure with the deformable portion being deformed ensuring retention of the sensor assembly in the slot structure, and coupling the first housing to the second housing with the clamping surface engaging a surface of the sensor assembly.

20. The method of claim 19, wherein the step of providing the second assembly include a sensor assembly having opposing ends, a pair of slot structures being provided, the inserting step including inserting an end, defining said portion, into an associated slot structure.

* * * * *